US007726248B2

(12) United States Patent
Shuert

(10) Patent No.: US 7,726,248 B2
(45) Date of Patent: Jun. 1, 2010

(54) TWIN SHEET PALLET

(75) Inventor: Lyle H. Shuert, Bloomfield Hills, MI (US)

(73) Assignee: Shuert Technologies, LLC, Sterling Heights, MI (US)

( * ) Notice: Subject to any disclaimer, the term of this patent is extended or adjusted under 35 U.S.C. 154(b) by 0 days.

(21) Appl. No.: 11/184,575

(22) Filed: Jul. 19, 2005

(65) Prior Publication Data

US 2006/0075939 A1 Apr. 13, 2006

Related U.S. Application Data

(60) Provisional application No. 60/616,825, filed on Oct. 7, 2004.

(51) Int. Cl.
*B65D 19/38* (2006.01)

(52) U.S. Cl. ..... 108/57.25

(58) Field of Classification Search ..... 108/52.1, 108/57.25, 57.26, 57.27, 57.28
See application file for complete search history.

(56) References Cited

U.S. PATENT DOCUMENTS 3,330,228 A * 7/1967 Donnelly ..... 108/57.27
3,433,184 A * 3/1969 Addy ..... 108/53.3
3,611,952 A * 10/1971 Hoffman ..... 108/11
3,667,403 A * 6/1972 Angelbeck, Jr. ..... 108/57.26
4,606,278 A 8/1986 Shuert ..... 108/51.1
4,742,781 A 5/1988 Shuert ..... 108/53.3
5,042,396 A * 8/1991 Shuert ..... 108/57.25
5,117,762 A * 6/1992 Shuert ..... 108/57.25
5,197,396 A * 3/1993 Breezer et al. ..... 108/56.3
5,255,613 A * 10/1993 Shuert ..... 108/52.1
6,386,118 B1 * 5/2002 Bendit et al. ..... 108/57.25

OTHER PUBLICATIONS

PCT/US05/35739; International Search Report and Written Opinion dated Sep. 6, 2006.
Three (3) sheets of material taken from the internet regarding pallet ("Arca Everest") manufactured by ArcaSystems.

* cited by examiner

*Primary Examiner*—José V Chen
*Assistant Examiner*—Matthew W Ing
(74) *Attorney, Agent, or Firm*—Young Basile Hanlon & MacFarlane, P.C.

(57) ABSTRACT

A plastic pallet comprising an upper plastic sheet and a lower plastic sheet. The lower sheet has a generally rectangular configuration, including sidewalls and end walls, and includes a plurality of separate parallel upwardly opening longitudinally extending U-shaped grooves extending from end to end of the sheet and a plurality of downwardly opening U-shaped grooves interspersed between the upwardly opening grooves and opening in the end walls of the sheet. The upper sheet defines a top wall and a plurality of upwardly opening U-shaped protrusions extending downwardly from the top wall and sized to nest within the upwardly opening grooves of the lower sheet, whereby the sheets may be fused together to form double thickness U-shaped wall structures at the interfaces of the protrusions and the upwardly opening grooves. The pallet further includes a pair of longitudinally extending metallic beams positioned between the upper and lower sheets.

19 Claims, 11 Drawing Sheets

TWIN SHEET PALLET

RELATED APPLICATION

This application claims the priority of U.S. Provisional Patent Application Ser. No. 60/616,825 filed on Oct. 7, 2004.

BACKGROUND OF THE INVENTION

This invention relates to shipping and storage pallets and more particularly to plastic pallets embodying a twin sheet construction.

Whereas twin sheet pallets have in general proven to be superior to the wooden pallets previously in use, the undersurfaces of the pallets tend to be irregular so that movement of the pallets over irregular transfer surfaces and over various transfer devices such as conveyors is difficult and sometimes impossible. Further, the prior art twin sheet pallets fail to make provision to preclude tipping of the pallet off of the forks of a forklift truck in the presence of an unbalanced load on the pallet. Further, the prior art twin sheet pallets have tended to creep or sag after extended periods of use.

SUMMARY OF THE INVENTION

This invention is directed to the provision of an improved twin sheet pallet.

More specifically, this invention is directed to the provision of a twin sheet plastic pallet which moves readily over transfer surfaces or transfer devices, which is resistant to tipping of the pallet off of the forks of a fork lift truck in the presence of an unbalanced load, and which is resistant to creepage or sag even after extended periods of usage.

The invention pallet is of the plastic twin sheet type comprising a generally rectangular upper plastic sheet and a generally rectangular lower plastic sheet selectively fused to the upper sheet, to form the pallet.

According to an important feature of the invention, the lower plastic sheet includes parallel, alternate, upwardly opening grooves and downwardly opening grooves extending from end to end of the sheet, and the upper plastic sheet has a generally planar top wall and a plurality of upwardly opening protrusions extending downwardly from the top wall and nestingly and fusedly received in the upwardly opening grooves in the lower sheet. This arrangement provides a simple, sturdy construction which resists creepage and provides a footprint facilitating smooth movement of the pallet over transverse surfaces or transfer devices.

According to a further feature of the invention, the lower sheet includes end walls and the downwardly opening grooves in the lower sheet open in the end walls. This specific construction further simplifies the construction of the pallet and further clarifies the smooth, continuous footprint of the pallet.

According to a further feature of the invention, each downwardly opening groove in the lower sheet is defined in part by a top wall; a series of upstanding knobs is provided on each groove top wall; the protrusions in the upper sheet are arranged in longitudinally extending rows; and portions of the top wall of the upper sheet between the rows are fused to the knobs. This specific arrangement provides a sturdy, simple twin sheet construction between the upper and lower sheets.

According to a further feature of the invention, laterally aligned slots are provided in sidewalls of the grooves and the protrusions to allow passage of the forks of a fork lift truck. This arrangement provides firm receipt of the forks of a forklift truck to discourage tipping.

According to a further feature of the invention, two longitudinally spaced protrusions are provided in each upwardly opening groove to provide longitudinally spaced laterally aligned sets of protuberances, and laterally aligned slots are provided in each set of protrusions and in the associated upstanding walls of the upwardly opening grooves and the downwardly opening grooves. This specific construction further facilitates the firm positive receipt of the two forks of the forklift truck.

According to a further feature of the invention, the lower sheet includes generally parallel upstanding side walls, generally parallel upstanding end walls, and a plurality of separate, flat, laterally spaced, parallel bottom walls extending from end wall to end wall, and the underfaces of the bottom walls define a pallet footprint comprised solely of a plurality of separate, flat, laterally spaced, parallel surfaces extending from end wall to end wall of the sheet. This specific construction further facilitates the movement of the pallet over transfer surfaces or transfer devices.

According to a further feature of the invention, the pallet further includes at least one metallic beam positioned between the upper and lower sheets and extending substantially from end wall to end wall of a pallet. This beam construction augments the bending strength to the pallet.

According to a further feature of the invention, the spacer knobs are arranged in laterally spaced longitudinally extending rows and the metallic beam is positioned between a top wall section of the lower sheet and a portion of the top wall of the upper sheet and extends substantially from end to end of the pallet between adjacent spacer knob rows. This arrangement allows the spacer knobs to further function to locate and retain the metallic beam.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
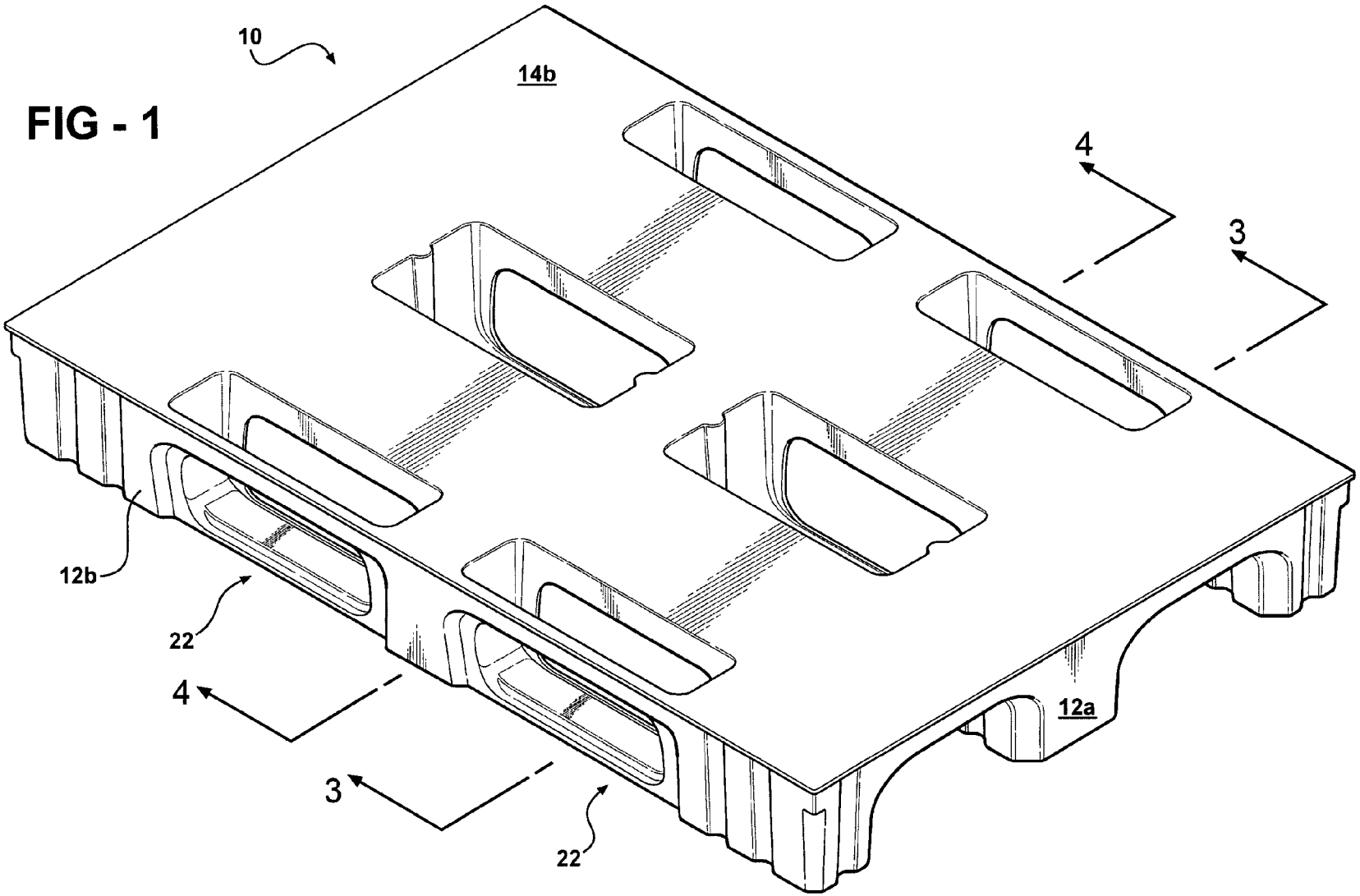
FIG. 1 is a perspective view of the invention pallet.
Figure 2:
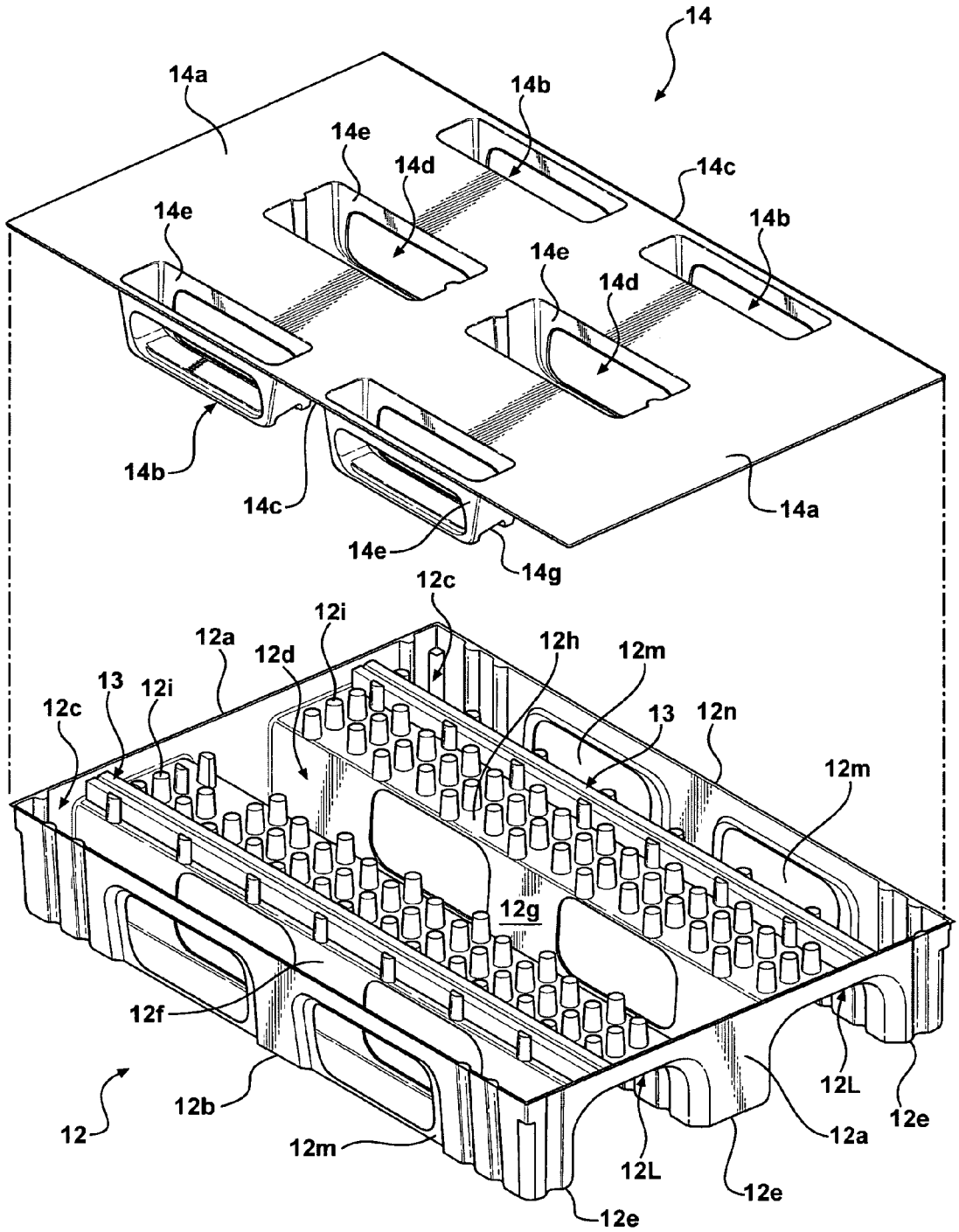
FIG. 2 is an exploded perspective view of vacuum formed upper and lower sheets utilized to form the pallet.
Figure 3:
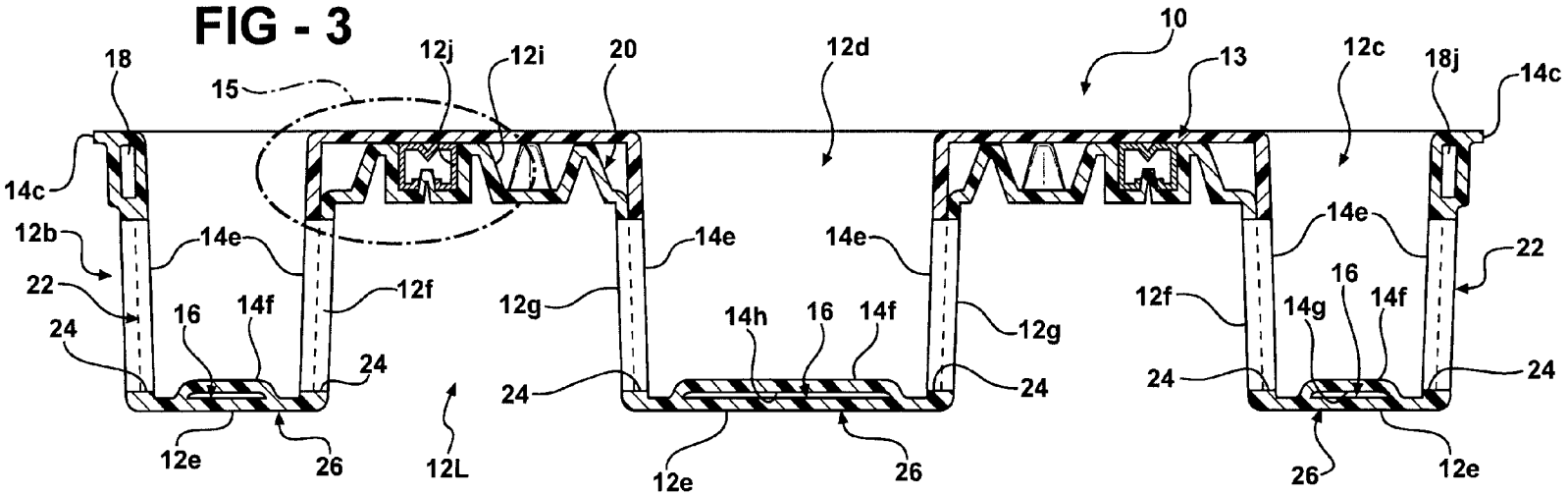
FIGS. 3 and 4 are cross-sectional views taken respectively on lines 3-3 and 4-4 of FIG. 1.
Figure 4:
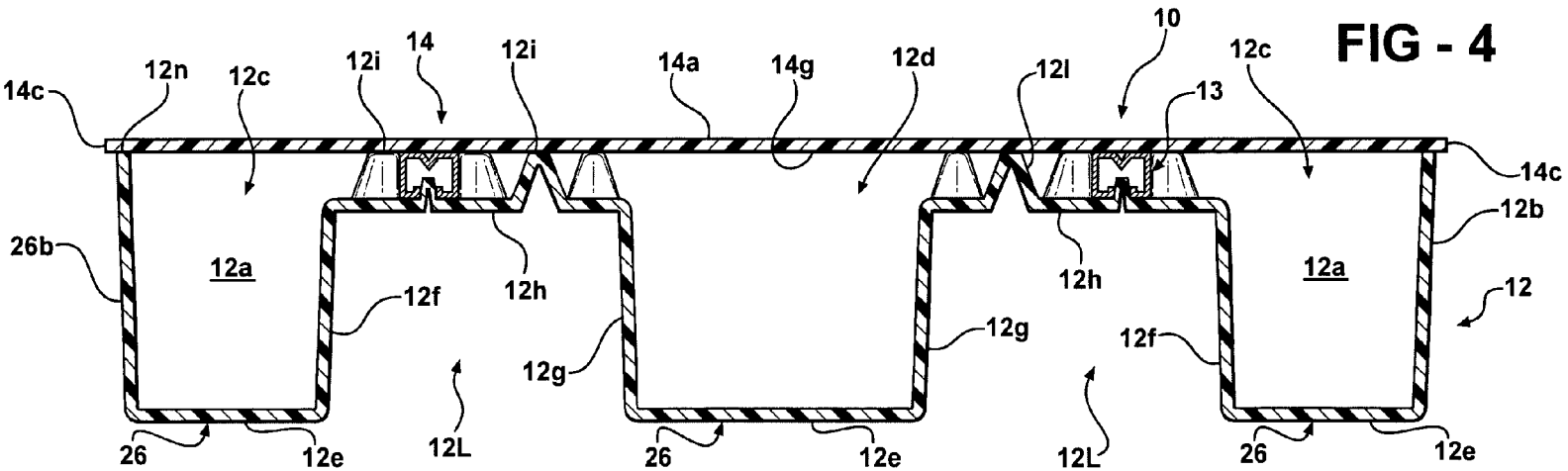
Figure 5:
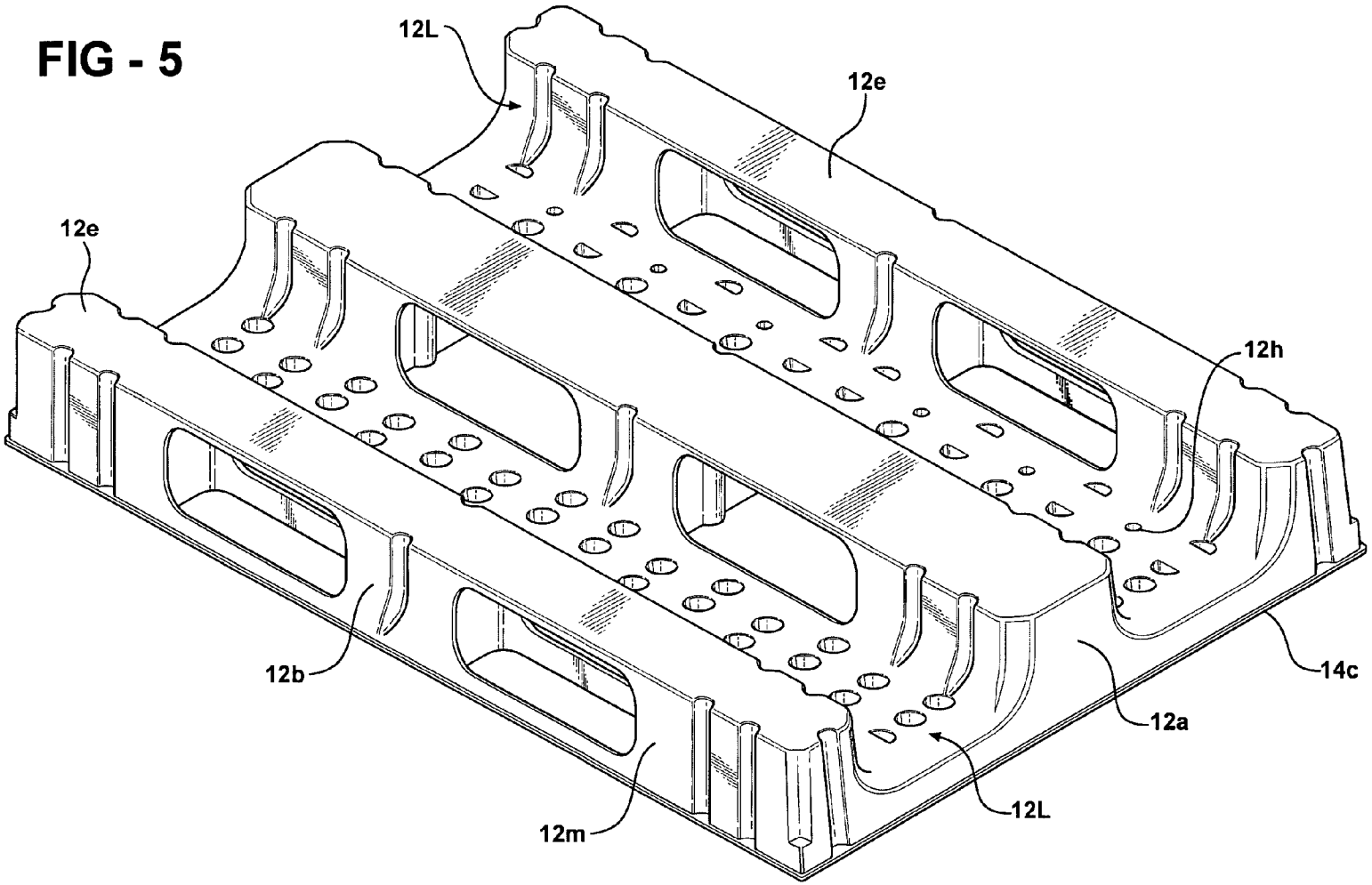
FIG. 5 is a perspective view of the pallet with the pallet in an upside down orientation.
Figure 6:
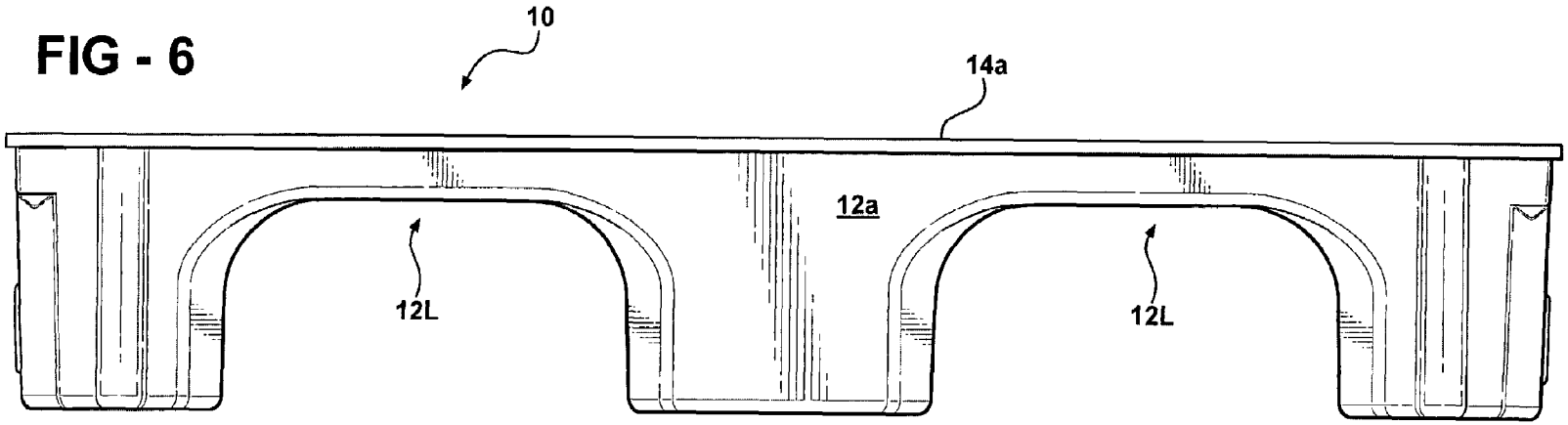
FIG. 6 is an end view of the pallet.
Figure 7:
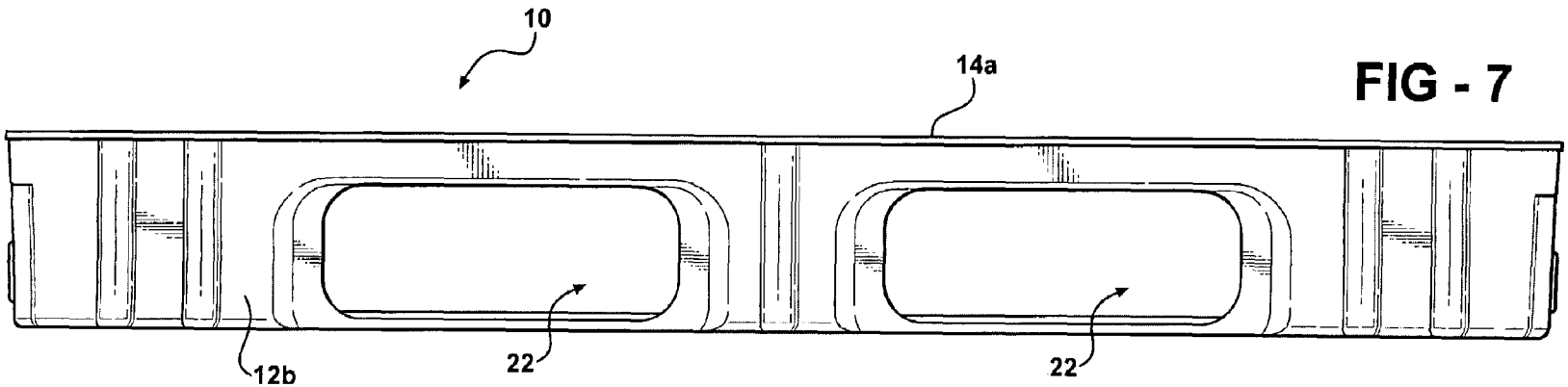
FIG. 7 is a side view of the pallet.
Figure 8:
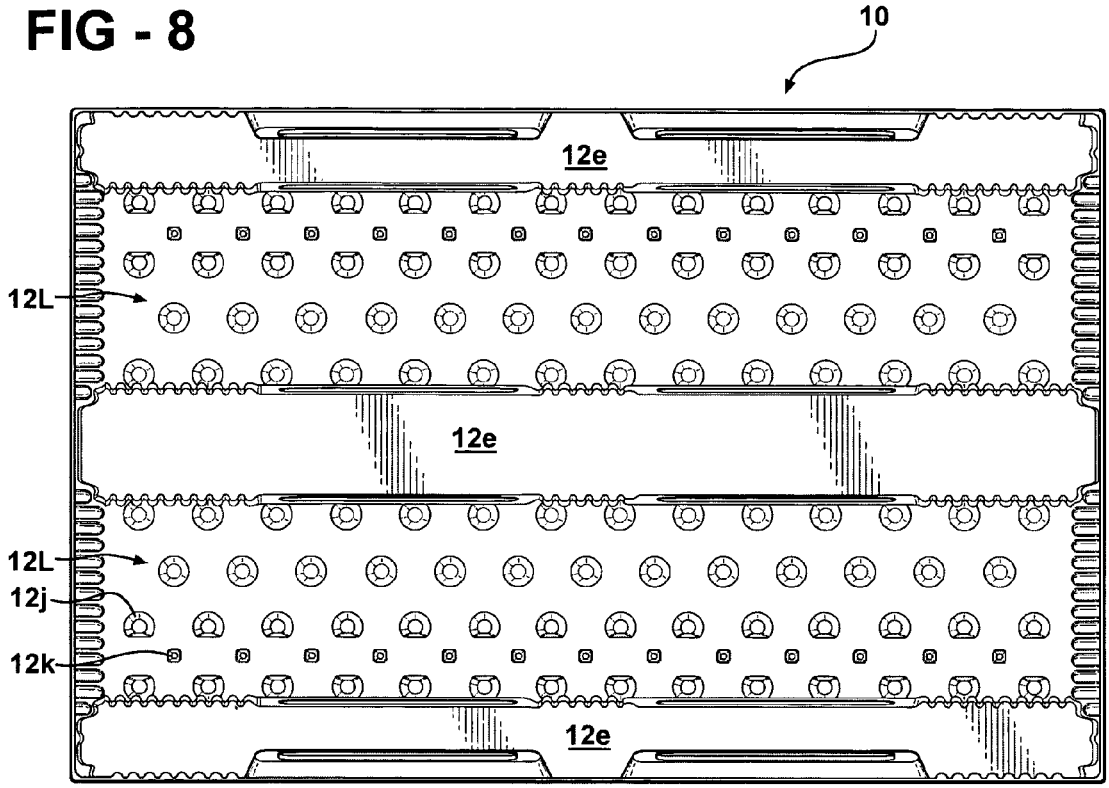
FIG. 8 is a bottom view of the pallet.
Figure 9:
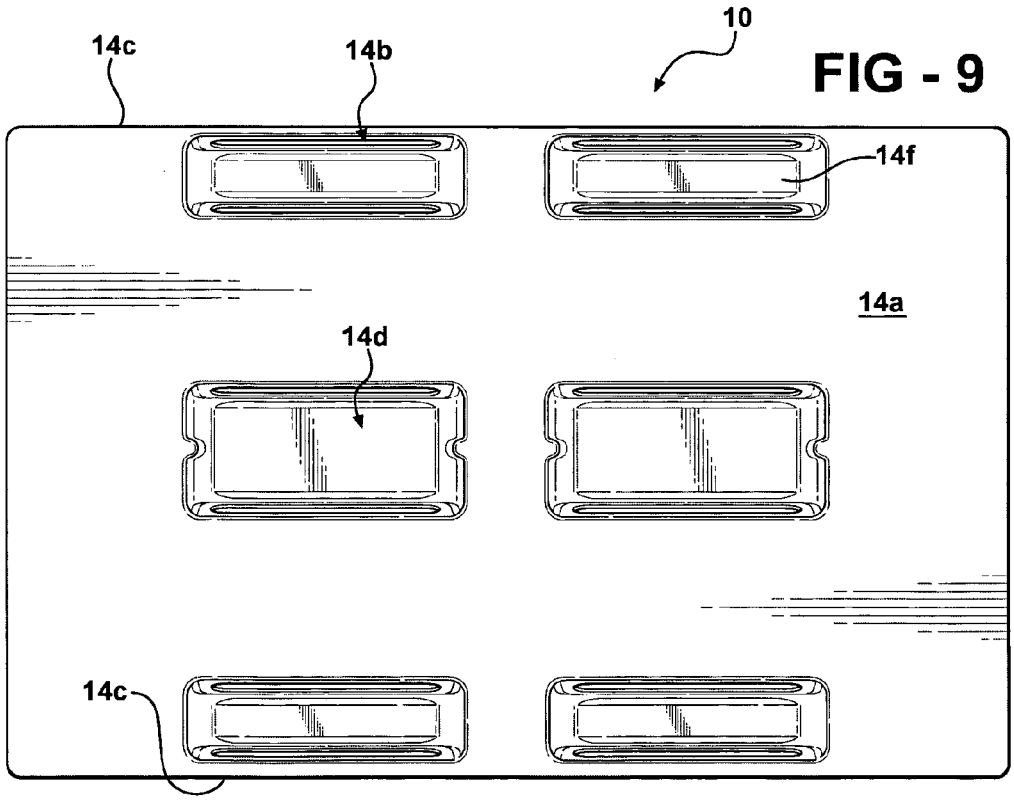
FIG. 9 is a top view of the pallet.
Figure 10:
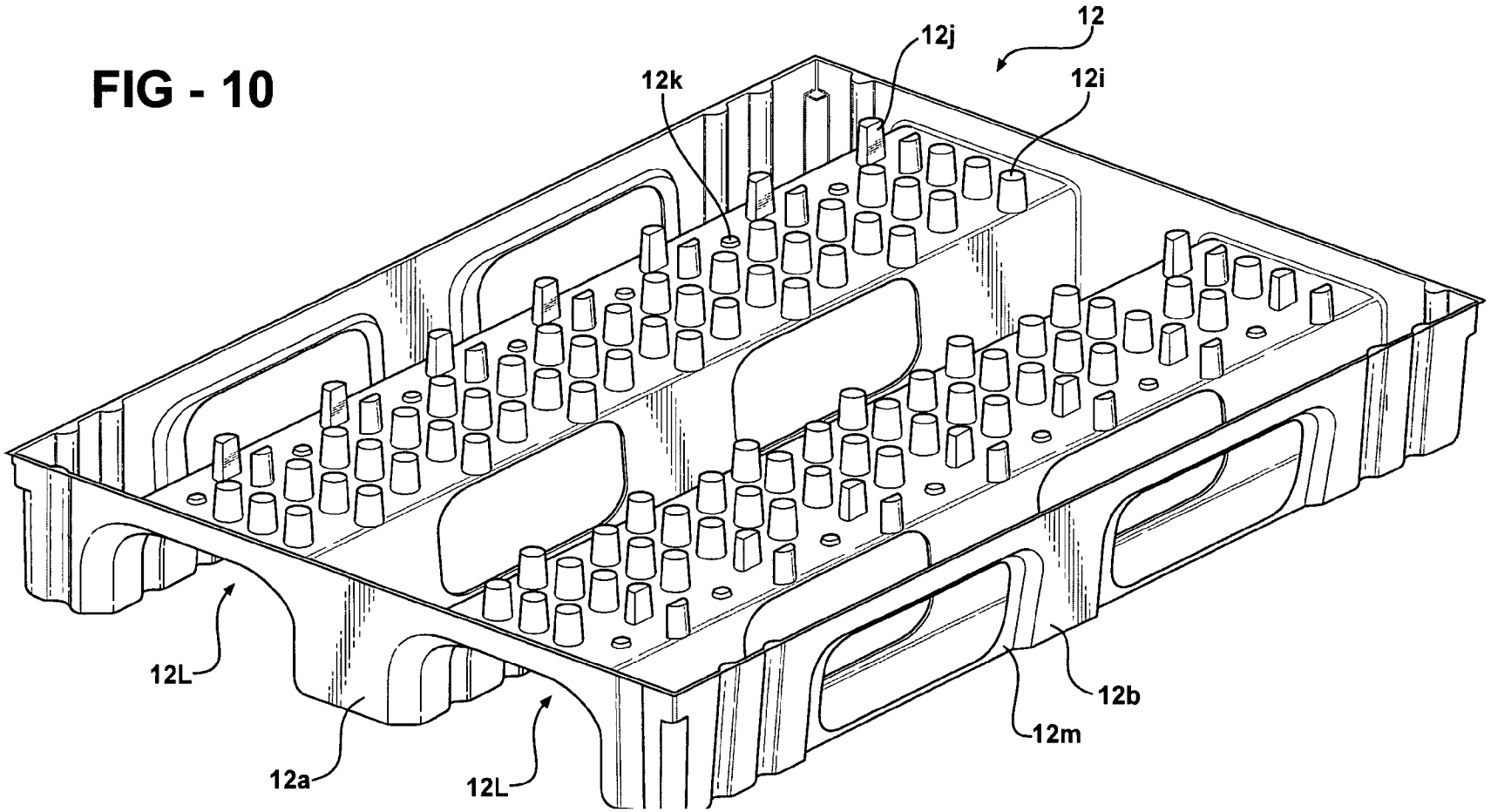
FIG. 10 is a perspective view of the lower sheet.
Figure 11:
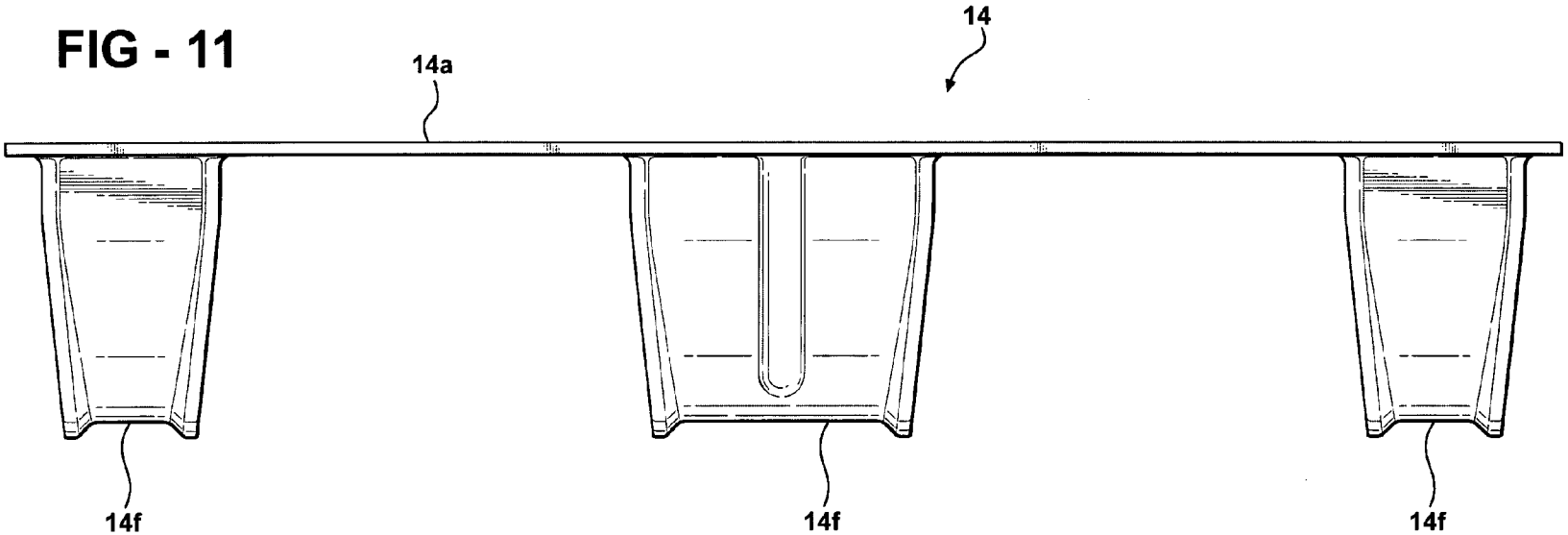
FIG. 11 is an end view of the upper sheet.
Figure 12:
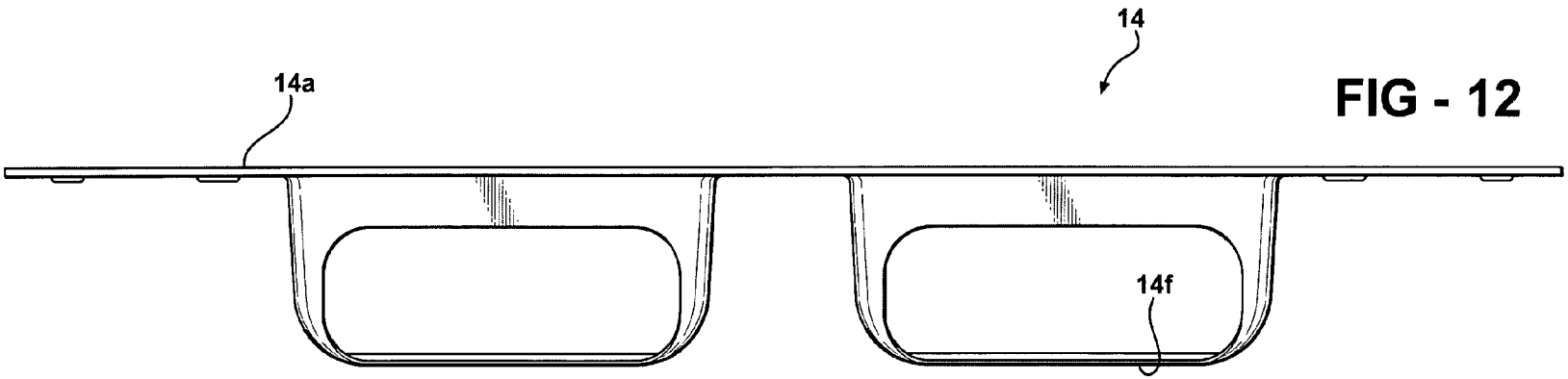
FIG. 12 is a side view of the upper sheet.
Figure 13:
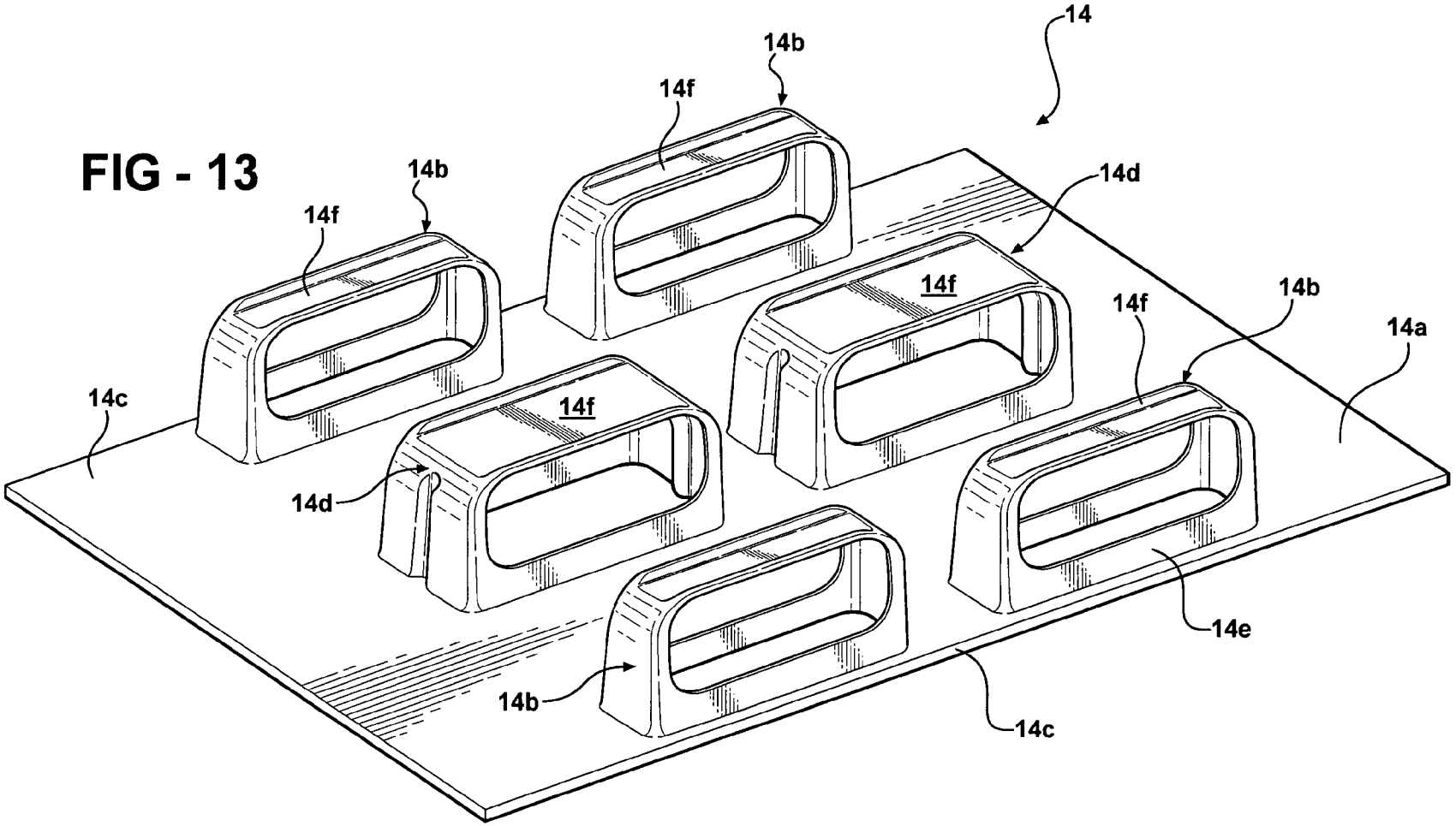
FIG. 13 is a perspective view of the upper sheet.
Figure 14:
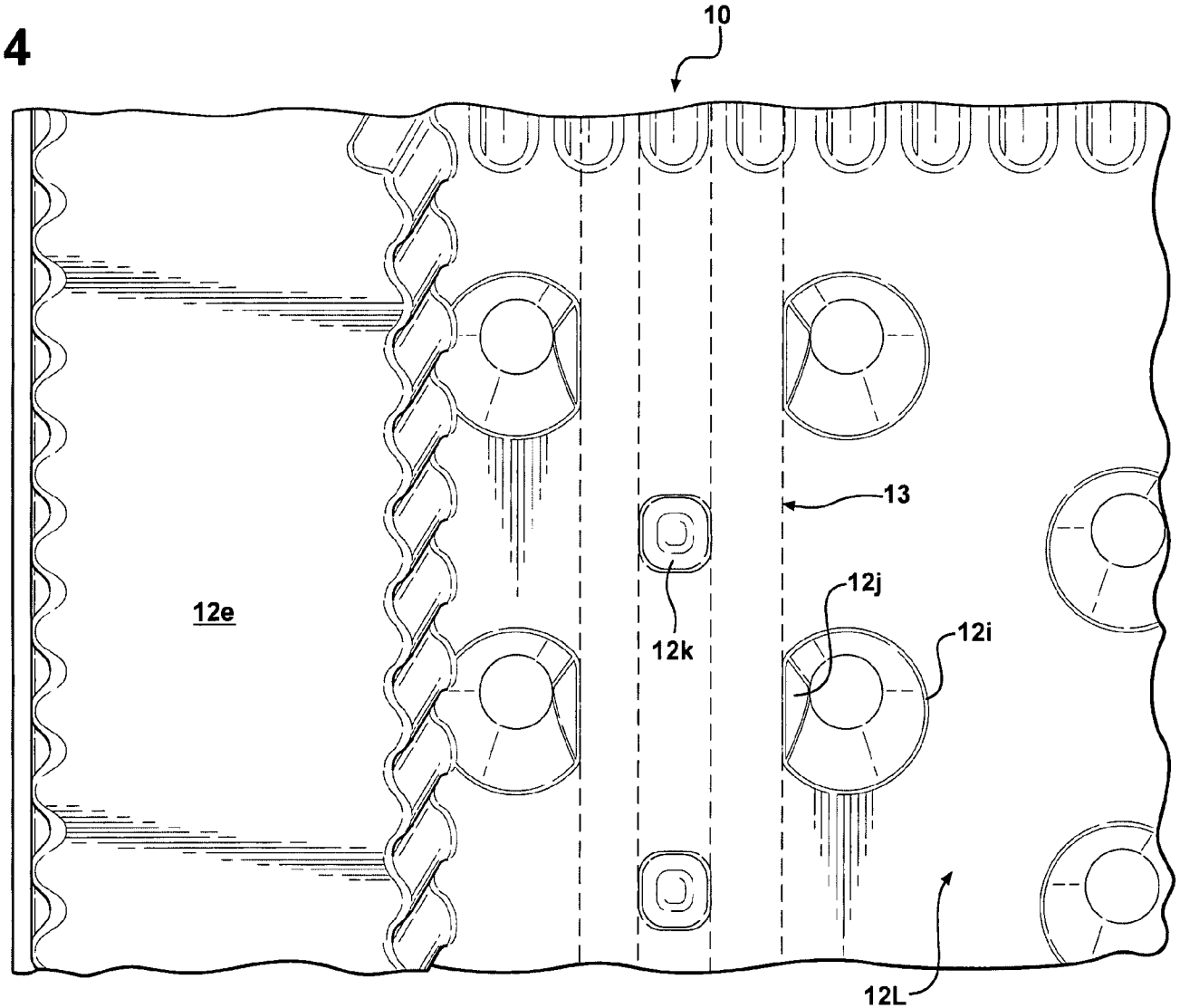
FIG. 14 is a fragmentary view of the lower sheet.
Figure 15:
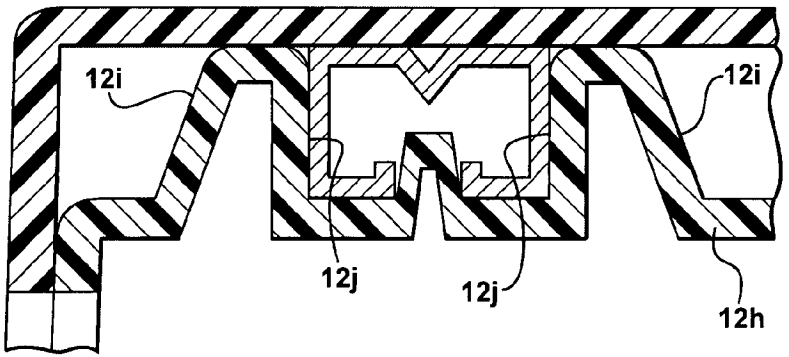
FIG. 15 is a fragmentary enlarged view taken within the circle 15 of FIG. 3.
Figure 16:
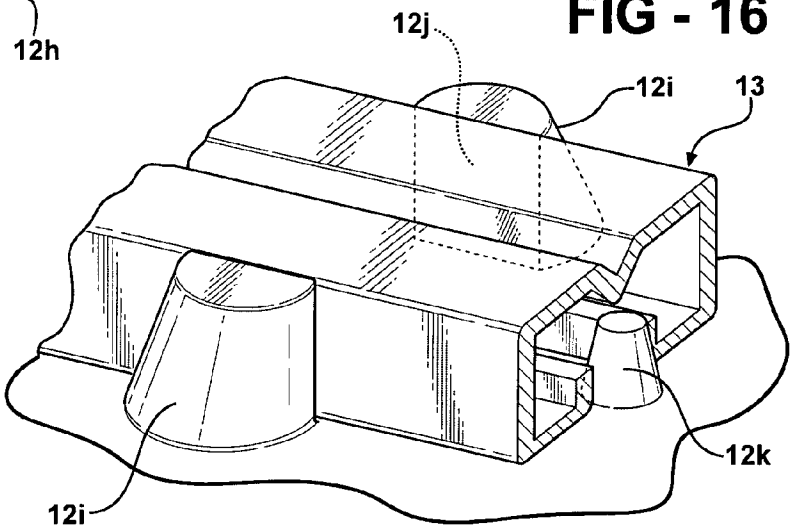
FIG. 16 is a fragmentary perspective view showing a pallet beam.
Figure 17:
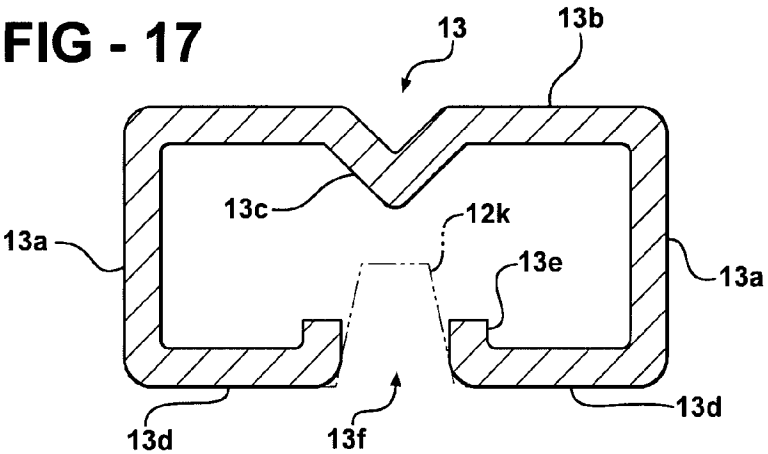
FIG. 17 is a cross-sectional view of a pallet beam.

In overview, the invention pallet 10 is formed of lower and upper plastic sheets 12 and 14, knitted or fused together, and a pair of reinforcing steel beams 13 positioned between the upper and lower sheets.

Sheets 12 and 14 may be separately molded in a vacuum forming process, may be formed of an organic polymeric material such as polyethylene, and may be knitted or fused together to form the pallet in a compression molding process. The molds for vacuum forming the sheets are not shown but may be constructed in accordance with known vacuum forming techniques.

Each of the upper and lower sheets is formed from a generally rectangular planar plastic sheet and the sheets are fused together utilizing the molds while the sheets are in a heated, moldable state so that fusion may occur between the upper and lower sheets at any point where an interface is defined between the upper and lower sheets.

Lower sheet 12 starts out as a generally rectangular sheet of polyethylene plastic material and is vacuum molded in known manner utilizing a suitable lower mold. Lower sheet 12 includes upstanding end walls 12*a*, upstanding sidewalls 12*b*, a longitudinally extending upwardly opening U-shaped side groove 12*c* proximate each sidewall 12*b* of the sheet, and a central longitudinally extending upwardly opening U-shaped groove 12*d* positioned between the side grooves 12*c*/12*c*. Each of the grooves will be seen to extend from a first end wall 12*a* to the other end wall 12*a* whereby each groove extends the full length of the pallet. Grooves 12*c*/12*d* all have substantially the same depth.

Each side groove 12*a* is defined by a respective upstanding sidewall 12*b*, a flat bottom wall 12*e*, and an upstanding inboard wall 12*f*. Central groove 12*d* is defined by spaced upstanding inboard walls 12*g* and a flat bottom wall 12*e*. Each inboard wall 12*g* of the central groove 12*b* is connected at its upper edge to the inboard wall 12*f* of a respective side groove 12*c* by a flat top wall 12*h* and a series of downwardly opening, upwardly extending hollow spacer knobs 12*i* are provided on the upper face of each top wall 12*h*. The knobs 12*i* are provided in laterally spaced rows along the entire length and width of the walls 12*h*. Knobs 12*i* have a circular truncated cone configuration except that the confronting faces 12*j* of the outboard knob rows on each top wall 12*h* are flatted to define a longitudinal channel for seating and locating of a respective beam 13. A row of downwardly opening upwardly extending locator knobs 12*k* are also provided in each top wall 12*h* between the rows of flatted outboard knobs. Locator knobs 12*k* are staggered with respect to, and smaller than, spacer knobs 12*i*. It will be seen that upstanding walls 12*f* and 12*g* and top walls 12*h* coact to define a pair of downwardly opening grooves 12*l* interspersed between upwardly opening grooves 12*c* and 12*d* and opening in end walls 12*a*. Each upstanding sidewall 12*b* is generally planar with the exception of a pair of longitudinally spaced depressions 12*m*.

Upper sheet 14 starts out as a generally rectangular sheet of polyethylene plastic material and is vacuum formed in known manner utilizing a suitable upper mold. Upper sheet 14 includes a generally planar top wall 14*a* and a plurality of upwardly opening U-shaped protrusions extending downwardly from the top wall. Specifically, a pair of elongated longitudinally extending and longitudinally spaced U-shaped protrusions 14*b* are provided proximate each side edge 14*c* of top wall 14*a* and a pair of elongated longitudinally extending and longitudinally spaced U-shaped protrusions 14*d* are provided in a central portion of the pallet. The protrusions all have substantially the same longitudinal extent and all have substantially the same depth. The protrusions in general have a size and cross-sectional configuration sized to nest snugly within the grooves 12*c*/12*d* and have a longitudinal extent and spacing corresponding to the depressions 12*m*. Each protrusion is defined by side walls 14*e* and a bottom wall 14*f*.

Each beam 13 has a length corresponding to the length of the pallet and, in cross-section, includes side walls 13*a*, a top wall 13*b* including a central "V" 13*c*, and spaced bottom wall sections 13*d* terminating in lips 13*e* defining a central slot 13*f*.

Following the vacuum forming operations to form the upper and lower sheets, and with the upper and lower sheets still in a heated moldable state, beams 13 are positioned between the outboard knob rows on each top wall 12*h* with side walls 13*a* of the beams seated against the confronting flatted faces 12*j* of the knobs and the locator knobs 12*k* protecting upwardly into slot 13*f*, and the molds are brought together in known fashion to compression press the upper sheet to the lower sheet to form the twin sheet pallet 10 with the beams encapsulated between the upper and lower sheets and specifically with each beam totally surrounded by upper sheet top wall 14*a*, a lower sheet top wall 12*h*, and knob flats 12*j*. As the upper and lower sheets, in a heated moldable state, are brought together the plastic material of the sheets fuses or knits together in known manner at all areas where the upper and lower sheets form an interface. Specifically, the periphery of the top wall 14*a* of the upper sheet fuses to the upper edge 12*m* of the lower sheet; the sidewalls 14*e* of each side protrusion 14*b* fuse to the inboard face of a depression 12*m* of the lower sheet and an inboard wall 12*f* of the lower sheet; the bottom walls 14*f* of the protrusions 14*b* fuse to outboard bottom walls 12*e* of the lower sheet; the sidewalls 14*e* of the central protrusions 14*d* fuse to sidewalls 12*g* of the lower sheet; the bottom wall 14*f* of each central protrusion 14*d* fuses to a respective portion of the central bottom wall 12*e* of the lower sheet; and the upper end of each hollow knob 12*i* fuses to the underface 14*g* of the top wall 14*a* of the upper sheet. As shown, the bottom wall 14*f* of each protrusion 14*b*/14*d* may be shaped to form a longitudinally extending downwardly opening groove 14*h* extending the entire length of the protrusion so that, as the upper and lower sheets are brought together, a void 16 is formed between each lower sheet bottom wall portion 12*e* and the bottom wall 14*f* of the associated protrusion. Further, and as noted, the protrusions 14*b* are sized such that the outboard wall 14*e* of each protrusion 14*b* actually seats against the inboard face of a respective indentation 12*m* so that a space 18 is formed between the upper and lower sheets above and along the extent of each indentation 12*m*. Further, the knobs 12*i* serve to define a space 20 between the upper and lower sheets in the pallet areas between the side grooves and the central groove. Spaces 16, 18 and 20 will be seen to define a twin sheet or double wall configuration for the pallet to provide structural rigidity for the pallet. Although the walls of the pallet where interfaced walls of the upper and lower sheets have been fused together are illustrated as having a thickness of twice the thickness of each interfaced wall, it will be understood that in most applications the final thickness of the interfaced and fused together walls will be less than twice the thickness of the separate walls.

Following the fusing together of the upper and lower sheets to form the pallet, and after allowing the material of the pallet to cool, a cutting or routing step is performed to form a pair of slots 22 extending laterally across the pallet to allow the entry of the forks of a forklift truck. Specifically, an oblong cut out 24 is formed in each depressed portion 12*m* of a side wall 12*b*, in the outboard sidewall 14*e* and the inboard sidewall 14*e* of the nested protrusion 14*b*, in an inboard wall 12*f*, in an inboard wall 12*g*, in the central protrusion sidewalls 14*e*, in an inboard wall 12*g*, in an inboard wall 12*f*, in the inboard and outboard sidewalls 14*e* of the nested protrusion 14*b*, and in the depressed portion 12*m* of the other side wall 12*b*. The laterally aligned cut outs 24 in the various walls of the pallet coact to define the respective fork slots 22 whereby to facilitate the handling of the pallet by a fork lift truck. In the completed pallet the planar top wall 14*a* of the upper sheet defines a generally planar platform surface for receipt of a pallet load and the bottom walls 12*e* of the lower sheet grooves 12*c*/12*d* coact to define a pallet footprint comprised solely of the flat parallel laterally spaced underfaces 26 of the bottom walls 12*e*.

The invention pallet will be seen to provide many important advantages. Specifically, the invention construction provides a continuous longitudinally extending footprint along the underface of the pallet so that the pallet can pass easily over barriers and irregular transfer surfaces and transfer devices such for example as conveyors.

The invention construction also provides firm entrapment for the forks of the fork lift truck so that the pallet, even if unevenly loaded, will not tend to tip off of the forks as the pallet is lifted and transported by the forks.

The invention construction also provides a very stiff and rigid pallet which resists creepage or sagging even over extended periods of use.

The invention pallet is also extremely simple in construction and therefore relatively inexpensive to produce and yet is extremely sturdy so as to provide an extremely long useful life.

The invention construction also lends itself to simple and effective cleaning operations between pallet usages.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A twin sheet plastic runner pallet comprising:

a generally rectangular lower plastic sheet including upstanding sidewalls and upstanding end walls and defining at least three separate, parallel, upwardly opening longitudinally extending U-shaped grooves extending continuously from end to end of the sheet, and at least two downwardly opening longitudinally extending U-shaped grooves interspersed between the upwardly opening grooves and opening in the end walls of the lower sheet, each upwardly opening U-shaped groove including laterally spaced vertical side walls and a bottom wall; and a generally rectangular upper plastic sheet defining a top wall providing a platform surface for the pallet and a plurality of upwardly opening U-shaped protrusions extending downwardly from the top wall and sized to nest within the upwardly opening grooves of the lower sheet, the protrusions arranged in at least three parallel longitudinally extending rows with at least two longitudinally spaced protrusions in each row, each U-shaped protrusion including laterally spaced vertical side walls and a bottom wall, the upper sheet positioned over the lower sheet with the protrusions positioned in the upwardly opening grooves and the laterally spaced vertical side walls of each U-shaped protrusion fused respectively to the laterally spaced vertical side walls of a respective upwardly opening U-shaped groove and the bottom wall of each U-shaped protrusion fused to the bottom wall of a respective upwardly opening U-shaped groove to form at least two double thickness U-shaped wall structures in each upwardly opening groove at the interfaces of the protrusions and the respective upwardly opening groove, each U-shaped wall structure thus formed in an upwardly opening groove being laterally aligned with U-shaped wall structures in the other upwardly opening grooves, each double thickness U-shaped wall structure including laterally spaced double thickness sidewall structures and a double thickness bottom wall structure;

the bottom walls of the upwardly opening U-shaped grooves coacting to define a pallet footprint consisting of at least three separate flat, laterally spaced parallel runner surfaces extending from end wall to end wall of the pallet;

the pallet further including laterally aligned cut-outs formed in the double thickness laterally spaced side wall structures of each double thickness U-shaped wall structure to form laterally aligned fork lift slots to accommodate the forks of a fork lift truck and allow passage of each fork through a plurality of aligned slots in a plurality of U-shaped wall structures to provide firm entrapment for the forks whereby the pallet even if unevenly loaded will not tend to tip off of the forks as the pallet is lifted and transported by the forks.

2. A pallet according to claim 1 wherein:

the upwardly opening grooves and downwardly opening grooves share common upstanding walls.

3. A pal let according to claim 2 wherein:

the upwardly opening grooves comprise a side groove extending along each sidewall of the lower sheet and a central groove; and each sidewall of the lower sheet constitutes an upstanding wall of a side groove.

4. A pallet according to claim 3 wherein:

two longitudinally spaced protrusions are provided in each upwardly opening groove.

5. A pallet according to claim 4 wherein:

the upstanding walls of adjacent upwardly opening grooves are connected by top wall sections of the lower sheet which also form the top walls of the interspersed downwardly opening grooves;

a series of upstanding spacer knobs are provided on each top wall section; and portions of the top wall of the upper sheet between the rows of protrusions are fused to the upstanding knobs.

6. A twin sheet plastic runner pallet comprising:

a generally rectangular lower plastic sheet having parallel side walls, parallel end walls, at least three separate parallel upwardly opening longitudinally extending grooves extending continuously from end wall to end wall of the sheet and alternate downwardly opening longitudinally extending grooves extending continuously from end to end of the sheet and opening in the end walls of the sheet; and a generally rectangular upper plastic sheet having a generally planar top wall defining a generally rectangular platform surface and a plurality of longitudinally and laterally spaced protrusions extending downwardly from the top wall, opening upwardly in the platform surface, and nestingly and fusedly received in the upwardly opening continuous grooves in the lower sheet;

the protrusions arranged in at least three parallel longitudinally extending rows with at least two longitudinally spaced protrusions in each row;

each upwardly opening groove including a continuous fiat bottom wall, the bottom walls coacting to define a pallet footprint consisting of at least three separate, flat, laterally spaced parallel longitudinally extending runner surfaces extending from end to end of the pallet;

at least two upwardly opening protrusions being nestingly and fusedly received in each upwardly opening groove;

each upwardly opening protrusion including a bottom wall, longitudinally extending sidewalls, and end walls;

the protrusions in each groove being positioned in the groove in longitudinally spaced relation with respect to each other and with respect to the end walls of the lower sheet so as to define longitudinally extending spaces in the groove between confronting end walls of adjacent protrusions and between protrusion end walls and the lower sheet end walls and so as to define a platform surface including continuous parallel longitudinal surfaces extending from end to end of the pallet between the upwardly opening grooves and continuous parallel lateral surfaces extending from side to side of the pallet proximate each end of the pallet as well as intermediate the ends of the pallet;

the pallet further including laterally aligned slots in fused together sidewalls of the upwardly opening grooves and the upwardly opening protrusions to provide at least two laterally extending slots to allow lateral passage of the forks of a fork lift truck.

7. A pallet according to claim 6 wherein:

each downwardly opening groove in the lower sheet is defined in part by a top wall;

a series of upstanding knobs is provided on each groove top wall;

the protrusions in the upper sheet are arranged in longitudinally extending rows; and portions of the top wall of the upper sheet between the rows are fused to the knobs.

8. A pallet according to claim 6 wherein:

the lower sheet further includes side walls extending between the end walls;

the upwardly opening grooves comprise a side groove extending along each side wall of the lower sheet and a central groove; and each side wall of the lower sheet constitutes an upstanding wall of a side groove.

9. A pallet according to claim 6 wherein the pallet further includes at least one beam positioned between the upper and lower sheets and extending substantially from end wall to end wall of the lower sheet.

10. A pallet according to claim 5 wherein:

the spacer knobs are arranged in laterally spaced longitudinally extending rows; and the pallet includes at least one metallic beam positioned between a top wall section of the lower sheet and a portion of the top wall of the upper sheet and extending substantially from end to end of the pallet between adjacent spacer knob rows in parallel relation to side edges of the pallet.

11. A pallet according to claim 10 wherein the pallet further includes upstanding locating knobs positioned between adjacent rows of spacer knobs and engaging an underface of the beam.

12. A pallet according to claim 11 wherein a beam is provided proximate and in parallel relation to each side edge of the pallet.

13. A plastic twin sheet runner pallet comprising an upper plastic sheet and a lower plastic sheet selectively fused to the upper sheet, characterized in that:

the lower sheet has a generally rectangular configuration, including substantially parallel continuous outer longitudinal sidewalls and substantially parallel lateral outer end walls extending continuously between the outer longitudinal sidewalls to form a continuous rectangular outer perimeter wall defining a continuous peripheral upper edge extending continuously around the perimeter of the sheet, and includes at least three separate, parallel, upwardly opening longitudinally extending U-shaped grooves extending continuously from end wall to end wall of the sheet and at least two downwardly opening longitudinally extending U-shaped grooves interspersed between the upwardly opening grooves and extending continuously between and opening in the end walls of the sheet;

the upper sheet has a generally rectangular configuration including a planar continuous downwardly facing surface extending around the entire perimeter of the sheet and is positioned over the lower sheet with the continuous downwardly facing planar surface fused to the continuous peripheral upper edge of the lower sheet to define a generally planar platform surface for the pallet;

each upwardly opening groove includes laterally spaced longitudinally extending vertical sidewalls and a continuous flat bottom wall, the bottom walls coacting to define a pallet footprint consisting of at least three separate flat laterally spaced longitudinally extending parallel runner surfaces extending from outer end wall to outer end wall of the pallet;

the upper sheet defines a top wall defining the platform surface and at least three parallel longitudinally extending and laterally spaced rows of upwardly opening U-shaped protrusions extending downwardly from the top wall with each row including at least two longitudinally spaced protrusions;

each U-shaped protrusion includes laterally spaced and longitudinally extending vertical sidewalls, a bottom wall, and end walls, the upper sheet positioned over the lower sheet with a row of at least two protrusions positioned in each upwardly opening groove and the laterally spaced vertical sidewalls of each U-shaped protrusion fused respectively to the laterally spaced vertical sidewalls of a respective upwardly opening U-shaped groove and the bottom wall of each U-shaped protrusion fused to the bottom wall of a respective upwardly opening U-shaped groove to form at least two longitudinally spaced double thickness U-shaped wall structures in each groove with each double thickness wall structure formed at the interface of a protrusion and a respective upwardly opening groove and with each double thickness U-shaped wall structure including laterally spaced double thickness sidewall structures and a double thickness bottom wall structure;

the pallet further includes laterally aligned cut-outs formed in the double thickness laterally spaced sidewall structures of each double thickness U-shaped wall structure, the cut-outs in the double thickness sidewall structures being laterally aligned to form at least two fork lift slots each extending laterally across the pallet from one outer longitudinal sidewall to the other outer longitudinal sidewall to provide firm engagement for the forks of a fork lift truck to preclude pal let tipping;

the protrusions in each groove being positioned in the groove in longitudinally spaced relation to the lateral end walls of the lower sheet so as to define longitudinally extending spaces in the groove between confronting end walls of adjacent protrusions and between protrusion end walls and the lower sheet end walls and so as to define a platform surface including continuous parallel longitudinally extending surfaces extending from end to end of the pallet between the upwardly opening grooves and continuous parallel lateral surfaces extending from side to side of the pallet proximate each end of the pallet as well as intermediate the ends of the pallet;

each downwardly opening groove being defined by a vertical side wait of an upwardly opening groove, a vertical side wall of an adjacent upwardly opening groove, and a flat top wall;

the lower sheet further defining a series of knobs upstanding from each flat top wall; and portions of the top wall of the upper sheet overlying the knobs and being fused to the knobs to define a twin sheet wall construction overlying the downwardly opening grooves and positioned above the forklift slots.

14. A pallet according to claim 13 wherein:

the pallet further includes a metallic beam positioned between each flat top wall and the overlying portion of the top wall of the upper sheet, extending substantially from end wall to end wall of the pallet, and positioned between upstanding spacer knobs.

15. A twin sheet, molded plastic, runner type industrial pallet with four-way forklift entry comprising:

a base portion and an integral deck portion;

the base portion comprising a generally rectangular plastic body having end walls with upper peripheral edges and including a plurality of parallel upwardly opening, continuous U-shaped sections forming parallel continuous runner legs, each of which is defined by opposed substantially parallel sidewalls joined at the bottom by a floor surface, each said runner leg extending fully between the end walls to define a pallet footprint consisting of three flat parallel, continuous and wholly separate runner leg floor surfaces extending from end wall to end wall;

said base portion including bridge members extending between adjacent runner legs and integral therewith;

said runner legs being spaced apart to define at least two downwardly opening first forklift openings extending the full length of the base portion between and through the end walls;

said bridge members defining at least two seat surfaces located between and extending parallel to said runner legs and between said end walls;

at least two metal beams disposed on said bridge members and extending in parallel between said end walls and over said forklift openings but below the upper peripheral edges of said end walls;

the deck portion comprising a top deck sheet fused to the base portion and having formed therein at least two space apart parallel rows of generally rectangular downwardly extending U-shaped, walled depressions of a width and depth to nest into and contact the sidewalls and floors of the runner legs, and extend substantially from said upper peripheral edges to the runner leg floors such that the depressions are substantially wholly nested within the runner legs and between the at least two first forklift openings;

each walled depression having an integral floor which rests on and is fused to a respective runner leg floor; and at least two parallel second forklift openings formed fully through the walls of the base portion legs and the depressions nestled within the legs, immediately below the beams and mediate the end walls but above the floors and at right angles to the downwardly opening first forklift openings so as to provide four-way forklift entry to the resulting pallet.

16. A twin sheet molded plastic runner type industrial pallet as defined in claim 15 further comprising spacer knobs between the bridge members and undersides of the top deck sheet.

17. A twin sheet molded plastic runner type industrial pallet as defined in claim 16 wherein at least some of the spacers straddle the metal beams to hold them in place.

18. A method of making a reinforced twin-sheet plastic runner pallet with four-way entry comprising the steps of:

molding a generally rectangular plastic base with three parallel U-shaped runner legs extending between end walls of the base, each leg having opposed side walls joined at the bottom by a floor surface, the legs spaced apart by upper bridge portions to define three parallel spaced-apart runner legs creating a pallet footprint consisting of three spaced-apart runner leg floor surfaces extending from end wall to end wall, the base further defining two parallel spaced apart downwardly opening grooves between grooves between the runner leg and grooves between the runner grooves between the runner legs grooves between the runner leg and opening in the end walls;

placing reinforcement beams on the bridge portions and between the end walls;

molding a plastic top with a top wall and two parallel rows of rectangular concavities with three concavities in each row and wherein the concavities in each row are spaced apart to match the spacing between the legs;

nesting the concavities of the top into the base legs so the top overlies the beams and knitting the plastic of the concavities to the plastic of the legs; and forming two parallel, spaced-apart forklift openings fully through the sidewalls of the legs and the concavities.

19. The method of claim 18 wherein the step of forming the openings is carried out after the steps of nesting and knitting.

* * * * *